US005658223A

United States Patent [19]

Habing et al.

[11] Patent Number: 5,658,223

[45] Date of Patent: Aug. 19, 1997

[54] RECUMBENT LEG EXERCISER

[75] Inventors: Theodore G. Habing, Long Beach; Ronald S. Gibson, Valencia; Douglas J. Habing, Manhattan Beach, all of Calif.

[73] Assignee: Pacific Fitness Corporation, Cypress, Calif.

[21] Appl. No.: 646,702

[22] Filed: May 3, 1996

Related U.S. Application Data

[63] Continuation of Ser. No. 285,875, Aug. 4, 1994, abandoned, which is a continuation of Ser. No. 86,815, Jul. 2, 1993, abandoned, which is a continuation of Ser. No. 838,158, Feb. 18, 1992, Pat. No. 5,254,067, which is a continuation-in-part of Ser. No. 541,919, Jun. 21, 1990, abandoned.

[51] Int. Cl.[6] ..... A63B 23/04

[52] U.S. Cl. ..... 482/53; 482/137

[58] Field of Search ..... 482/56–65, 96–100, 482/104, 112, 113, 130, 136–138; 601/34, 35

[56] References Cited

U.S. PATENT DOCUMENTS

| | | | |
|---|---|---|---|
| 1,176,365 | 3/1916 | Hartnett | 482/56 |
| 2,921,791 | 1/1960 | Berne | 482/118 |
| 3,062,204 | 11/1962 | Stefano | 482/57 X |
| 3,712,613 | 1/1973 | Feather et al. | 482/142 X |
| 3,784,194 | 1/1974 | Perrine | 482/113 |
| 3,858,873 | 1/1975 | Jones . | |
| 4,240,627 | 12/1980 | Brentham . | |
| 4,262,902 | 4/1981 | Dranselka | 482/60 |
| 4,285,515 | 8/1981 | Gezari | 482/57 |
| 4,372,551 | 2/1983 | Yurdin | 482/57 |
| 4,509,745 | 4/1985 | Angsten | 482/98 |
| 4,538,804 | 9/1985 | Libell | 482/57 |
| 4,684,126 | 8/1987 | Daleboot et al. | 482/118 X |
| 4,730,829 | 3/1988 | Carlson | 482/137 X |
| 4,798,379 | 1/1989 | Jenkins | 482/53 |
| 4,830,363 | 5/1989 | Kennedy | 482/56 |
| 4,863,161 | 9/1989 | Telle | 482/97 |
| 4,909,504 | 3/1990 | Yang | 482/138 |
| 4,936,573 | 6/1990 | Miller | 482/118 |
| 4,989,858 | 2/1991 | Young et al. | 482/53 |

OTHER PUBLICATIONS

Kinetron (advertisement) 1972.

Kinetron (brochure) 1972.

Mercer Hospital Physical Therapy Department. Clinical Evaluation of the Kinetron: Newsletter . . . devoted to Isokinetics 1972.

Savander, Gary R. Use of the Kinetron in the training of the below–knee amputee. Physical Therapy 52(3) 1972.

"Isokinetic Pre–Ambulation Weight–Bearing Therapy with the Kinetron", James J. Perrine, 1971.

*Primary Examiner*—Richard J. Apley

*Assistant Examiner*—John Mulcahy

*Attorney, Agent, or Firm*—Blakely, Sokoloff, Taylor & Zafman

[57] ABSTRACT

A longitudinal frame supports a seat whose longitudinal position on the frame is adjustable. A pair of footbeams are mounted on either side of the forward end of the frame near the floor and extend generally upwardly. The footbeams independently pivot on the frame so that the user can operate them in an alternating reciprocating fashion. Pivotal movement of the footbeams by the user is resisted, thereby requiring the user to expend energy in operating the device. The footbeams are preferably interconnected so that their respective movements am coordinated. In alternative embodiments, the footbeams pivot about a point just below the seat. The seat can also be adapted to recline, preferably at an angle greater than 30° from the vertical. The footbeams can also be replaced by a crank with footpedals that are used to drive a flywheel and a generator.

11 Claims, 8 Drawing Sheets

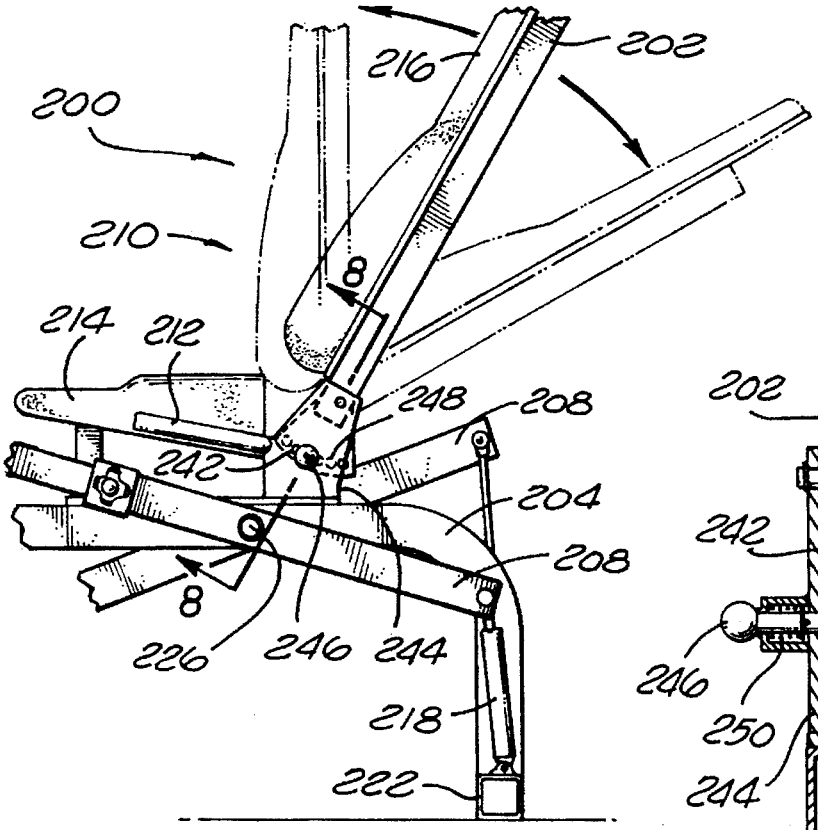
FIG. 7
FIG. 8
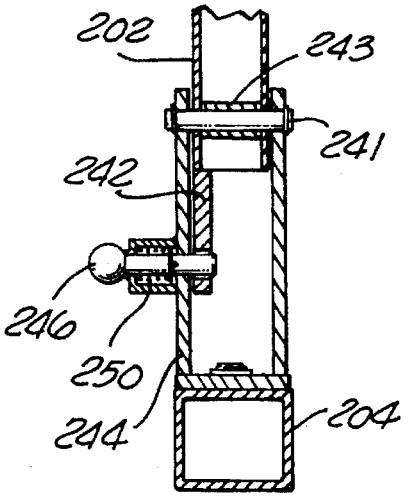

RECUMBENT LEG EXERCISER

This is a continuation of application Ser. No. 08/285,875 filed on Aug. 4, 1994, now abandoned, which is a continuation of Ser. No. 08/086,815 filed on Jul. 2, 1993, now abandoned, which is a continuation of Ser. No. 07/838,158 filed on Feb. 18, 1992, now U.S. Pat. No. 5,254,067, which is a continuation-in-part of Ser. No. 07/541,919 filed on Jun. 21, 1990, now abandoned.

BACKGROUND OF THE INVENTION

1. Field of the Invention

This invention relates to exercise equipment, and particularly to an apparatus in which a recumbent user may engage in both leg development and aerobic exercise.

2. Background Art

There are a wide variety of well-known exercise devices for developing the muscle groups of the legs. For example, the leg press exercise, whereby a recumbent person pushes against a resistance with one or both legs, may be performed on a number of dedicated exercise machines and on many multi-station machines as well.

Another class of leg exercise devices are those that simulate riding a bicycle. Generally these are intended to provide aerobic exercise in addition to development of the leg muscles. Some such devices are generally upright in the manner of a conventional bicycle, while others are configured so that the user is in a recumbent position while pedalling. Such a position provides greater support for the user's back and is generally more comfortable, especially for extended periods of use.

Recently, a number of exercise machines have been commercially introduced that simulate stair climbing. These devices are also generally intended to provide aerobic exercise as well as development of the leg muscles. One example of such a device is disclosed in U.S. Pat. No. 4,838,543.

One of the objects of the present invention is to provide an exercise apparatus that combines the comfort and support of a recumbent exercise position with a striding-type of exercise such as is afforded by conventional upright devices of the type that simulate stair climbing.

Another object of the present invention is to provide a recumbent leg exerciser that offers greater resistance than a conventional stair-climbing exerciser.

Yet another object of the present invention is to provide a recumbent leg exerciser that selectively emphasizes different muscle groups.

SUMMARY OF THE INVENTION

One embodiment of the present invention is constructed on a longitudinal frame supported on the floor. A seat is supported on the frame and the longitudinal position of the seat on the frame is adjustable. A pair of footbeams are mounted on either side of the forward end of the frame near the floor and extend generally upwardly. Footpads are provided at the upper ends of the footbeams so that a seated user can comfortably engage the footbeams with his feet.

The footbeams independently pivot on the frame so that the user can operate them in an alternating reciprocating fashion, A shock absorber device or other suitable resistance means is coupled between each of the footbeams and the frame to resist pivotal movement of the footbeams by the user and thereby require the user to expend energy in operating the device.

Pivotal movement of the footbeams may be completely independent, or the footbeams may be interconnected so that their respective movements are coordinated. In one embodiment, the footbeams are coupled so that forward pivotal movement of one of the footbeams causes the opposite footbeam to pivot rearwardly. Thus, as the user pushes forward with one leg, the other leg is forced back, In another embodiment, the footbeams are coupled so that either forward or rearward movement of one of the beams causes reciprocal pivotal movement of the opposite beam.

In an alternative embodiment, the present invention provides that the footbeams be pivotally connected to the frame at a position just below the seat. More specifically, the footbeams are attached to the frame at an intermediate position to a pivot point on the frame that is located just below the seat. In this embodiment, the resistance means are moved to the back, where they are attached to the support member and the footbeams. The distance between the seat and the footpads can also be adjusted since each footbeam has a telescoping length. That is, each footbeam is divided into multiple sections wherein one section can collapse axially into a larger-opening section. Furthermore, the pulley mechanism mentioned above can be incorporated to force each footbeam to alternately reciprocate 180 degrees out of phase.

In yet another alternative embodiment, the present invention provides a recumbent exerciser that features a seat that is capable of reclining. Preferably, the seat has a beck cushion supported by a sector-shaped plate with holes spaced around the perimeter. A mounting plate affixed to the frame engages the sector-shaped plate. A locking pin extending perpendicular through the mounting plate engages one of the holes when the sector-shaped plate is properly aligned therewith. Thus, the degree of recline of the beck cushion can be set according to which hole the locking pin engages. In a modification of this embodiment, the same hardware can be adapted for use with the seat cushion, too. The seat is thus capable of not only seatback recline, but also seat tilt.

In this reclining seat embodiment, the resistance means is no longer connected to the seatback support member as in the embodiment above. Rather, the resistance means interconnects the rearward portion of each footbeam to the frame of the exerciser, preferably at the rear lateral support member.

In still another alternative embodiment, the present invention provides a recumbent exerciser utilizing a crank and pedal arrangement. In this embodiment, a crank set having footpedals mounted to the front of the exerciser replaces the footbeams of the previous embodiments. As the user pedals the crank, torque is transmitted to a chain-driven sprocket, also mounted to the frame. A flywheel is rotated by the sprocket. The flywheel helps stabilize the operation of the exerciser so that resistance encountered by the user appears smooth and constant during the exercise regimen. As the flywheel is rotated by the sprocket, the former transfers torque through a belt to a generator. The torque is dissipated as heat by electrical resistance coupled to the output of the generator. Thus, the resistance means in this embodiment is electrical rather than mechanical.

Moreover, the seat can be adjusted longitudinally along the length of the frame to accommodate the length of the user's legs. Needless to say, the seat can be modified to recline if necessary as shown in the preceding embodiments.

BRIEF DESCRIPTION OF THE DRAWINGS

FIG. 7 is a detailed view of an alternative embodiment using a reclining seat.

FIG. 8 is a sectional view taken along line 8—8 of FIG. 7.

DETAILED DESCRIPTION OF THE INVENTION

In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details. In other instances, detailed descriptions of well known mechanical elements are omitted so as to not obscure the description of the present invention with unnecessary detail.

Figure 1:
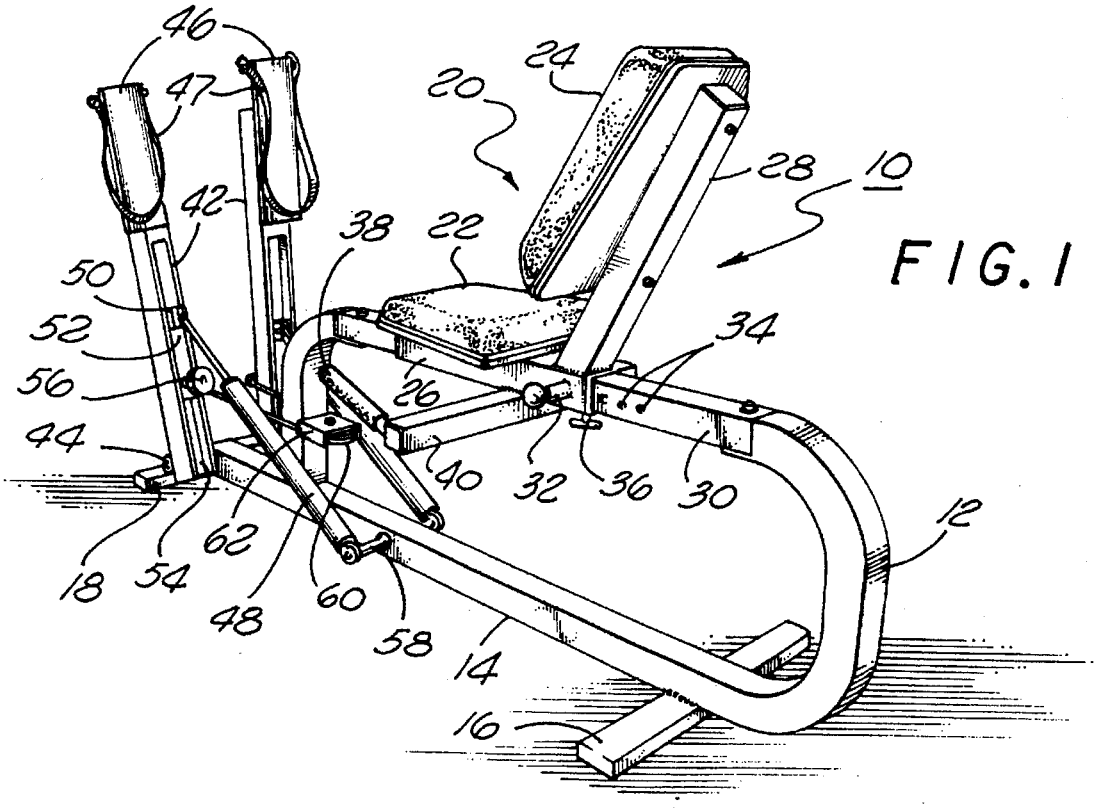
FIG. 1 is a perspective view of a preferred embodiment of the present invention.
Figure 3:
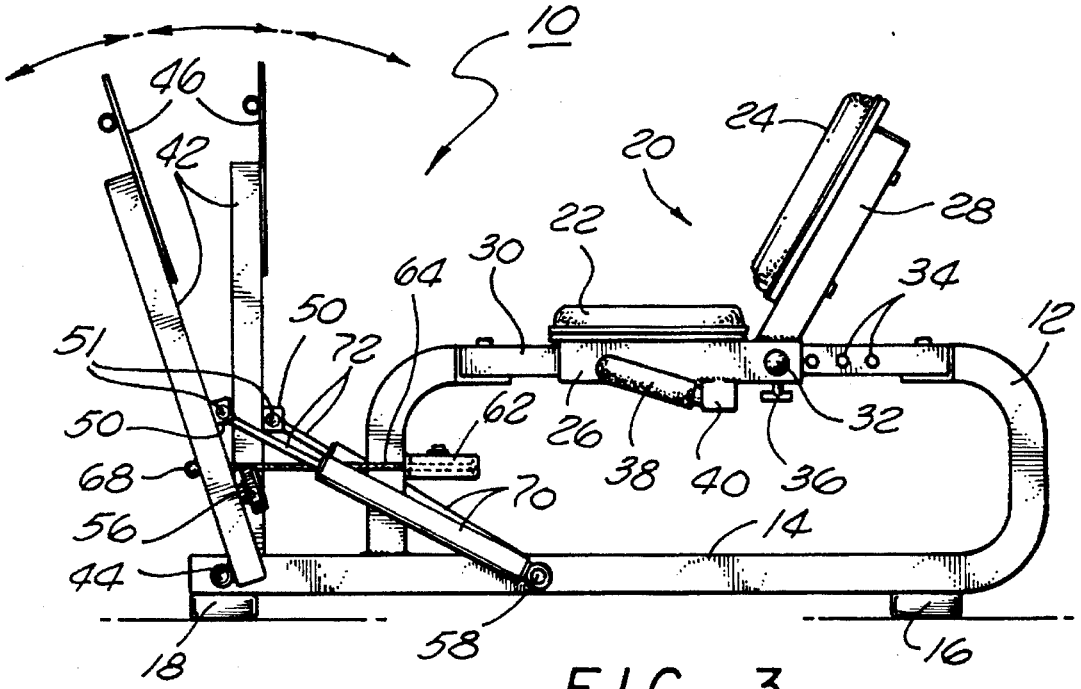
FIG. 3 is a side elevation view of the exerciser of FIG. 1.

Referring primarily to FIGS. 1 and 3, a recumbent leg exercise apparatus 10 is shown. A frame 12 comprises a base member 14 and lateral support members 16 and 18. These lateral support members extend a sufficient distance on either side of frame 12 so as to provide a stable footing for apparatus 10 on a floor surface. The principal structural components of apparatus 10 are preferably fabricated from square and rectangular steel tubing, although other steel shapes and shapes of other materials may also be employed. Lateral support members 16 and 18 are preferably welded to frame 12, but may be attached by other conventional means.

A seat 20 is provided for the user of the apparatus. Seat 20 comprises a seat cushion 22 and a back cushion 24. Cushions 22 and 24 are of conventional construction comprising, for example, a rigid substrate of plywood or similar material, a foam cushioning material and a vinyl cover. Seat cushion 22 is secured to support member 26 which is a length of tubular material of suitable dimensions so that it telescopes over frame member 30. Back cushion 24 is secured to support member 28, which is welded or otherwise secured to seat support member 26. Support member 28 is inclined with respect to member 26 at an angle for firmly and comfortably supporting the back of the user during operation of the apparatus. If desired, suitable angle adjusting means may be incorporated to selectively vary the angle of support member 28 relative to support member 26.

The longitudinal position of seat 20 on frame 12 is preferably adjustable to accommodate users of different heights. As already stated above, seat support member 26 telescopes over support member 30. A spring-loaded indexing pin 32 is provided on support member 26 for engagement with one of a plurality of indexing holes 34 drilled laterally through support member 30. To prevent any wobble of seat 20 about frame member 30 once the desired longitudinal position has been selected, locking screw 36 is provided on support member 26. Locking screw 36 is threaded through the wall of support member 26, or preferably through a nut welded to the underside of member 26. After adjusting the longitudinal position of seat 20, locking screw 36 is tightened until it firmly engages the underside of frame member 30, thereby firmly securing seat 20 in position on frame member 30.

To assist the user in maintaining a comfortably seated position while performing exercises on apparatus 10, handgrips 38 are provided on either side of seat 20. Handgrips 38 are supported by lateral support member 40 which is welded or otherwise secured to support member 26. Handgrips 38 thus remain fixed in position relative to seat 20 as the longitudinal position of seat 20 on frame 12 is adjusted. Handgrips 38 are preferably fabricated from round bar or tubing and are preferably covered with a slightly resilient material such as a high density foam for the comfort of the user.

A pair of identical footbeams 42 are pivotally mounted in laterally adjacent positions at the forward end of frame 12. Footbeams 42 are mounted on respective pivot pins 44 that extend laterally from either side of base member 14. Each of footbeams 42 pivots through an arc as indicated by the arrows in FIG. 3 such that a user may engage the footbeams with his feet and operate the footbeams through the indicated arc or a portion thereof with a pumping or striding motion. A footpad 46 is secured to the upper end of each of footbeams 42 to provide substantially flat operating surfaces for the feet of the user. Ankle straps 47 are provided at each of footpads 46 to support the user's legs while operating the exerciser.

Respective pivotal movement of each of footbeams 42 by the user is resisted by resistance means 46. Any one of a number of conventional resistance means may be employed, such as a spring arrangement or a weight and pulley arrangement. However, the preferred form of resistance means is a pneumatic or hydraulic piston assembly as illustrated. Piston assemblies 48 are attached to frame 12 by respective pivot pins 58 extending laterally from either side of base member 14. Each of piston assemblies 48 comprises a cylinder 70 and a piston rod 72. Each piston assembly 48 is preferably valved such that resistance is provided both during compression and extension. It will be appreciated that differential exercise of the leg muscle groups may be achieved by having greater or lesser resistance during compression than during extension.

The degree of resistance offered by piston assembly 46 to pivotal motion of the respective footbeam 42 may be conveniently adjusted by varying the location of the point at which piston rod 72 is coupled to the footbeam, it being recognized that a coupling point closer to footpad 46 will involve a greater stroke of piston rod 72 for a given arc of motion, thereby requiring greater effort on the part of the user. Each footbeam 42 includes a channel portion 54 within which an adjusting member 52 is slideably disposed. Adjusting member 52 includes a clevis portion 50 protruding therefrom. Piston rod 72 is pivotally coupled to clevis portion 50 by bolt 51. Adjusting member 52 is secured in position within channel portion 54 of footbeam 42 by suitable means such as locking screw 56.

Figure 2:
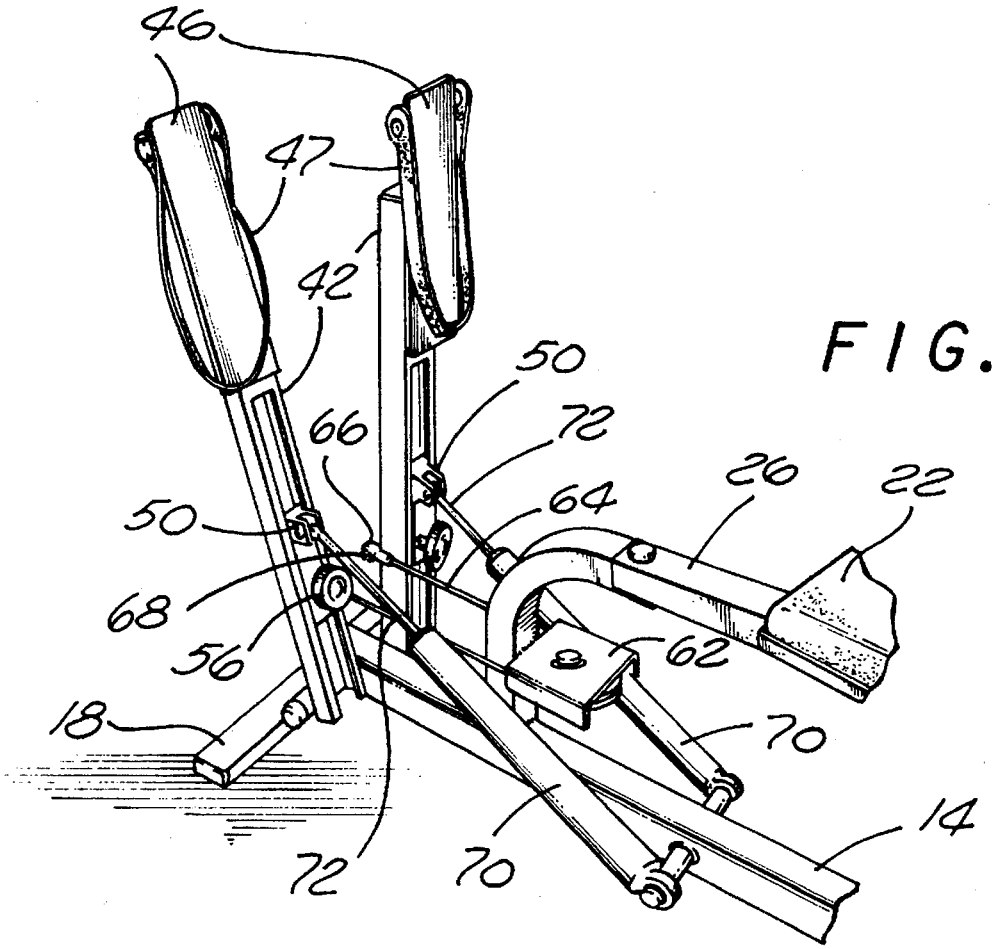
FIG. 2 is a detailed perspective view of the forward portion of the exerciser of FIG. 1.

Referring now also to FIG. 2, footbeams 42 are preferably interconnected in such a way that forward pivotal motion of one of the footbeams will cause the other footbeam to pivot rearwardly. Thus, as the user presses forward against one of the footpads, the opposite footbeam will return towards the user so that a striding exercise is achieved. In the illustrated embodiment, a pulley and cable arrangement are provided for interconnecting the footbeams. Pulley 60 is attached to frame 12 by means of bracket 62 which is welded or otherwise secured to the frame member. Cable 64 passes around pulley 60 and terminates at either end in eyelet fittings 66. The cable ends are secured to the footbeams by bolts 68 or other suitable means. While such a cable and pulley arrangement is preferred as a means of interconnecting footbeams 42, this may also be accomplished by an arrangement of levers, a chain and sprocket, gears or other conventional mechanical couplings.

Figure 4:
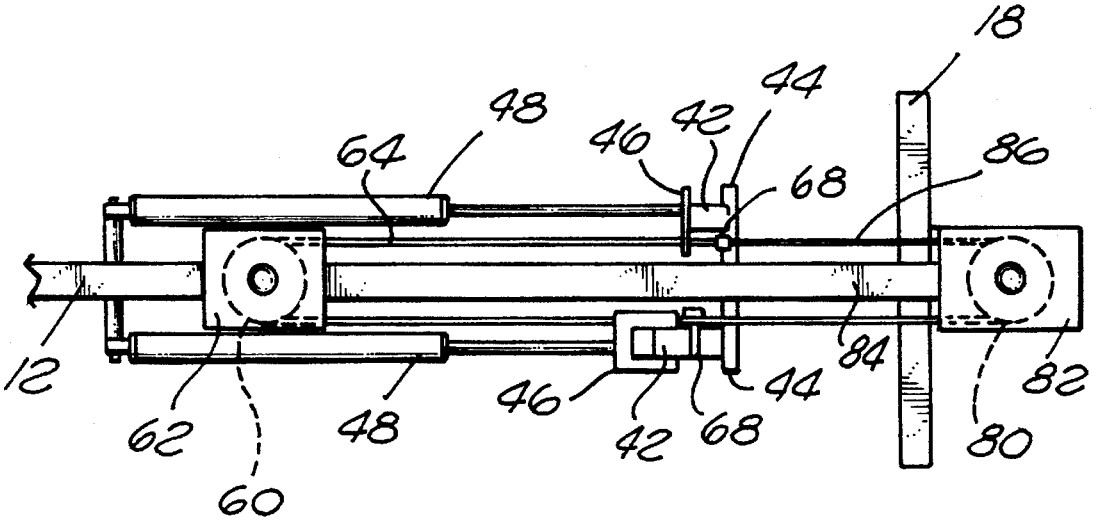
FIG. 4 is a partial plan view of a modified embodiment of the present invention.

Referring now to FIG. 4, a modification of apparatus 10 is illustrated. In the embodiment thus far described, forward pivotal motion of one of the footbeams will cause the other footbeam to pivot rearwardly. However, rearward pivotal motion of one of the footbeams will simply allow cable 64 to go slack and will have no effect on the opposing footbeam. To obtain full-time coordination of the footbeams, an additional pulley 80 may be mounted forward of the pivot points 44. Pulley 80 is mounted on bracket 82 which is supported by extended frame member 64. With extended frame member 84, lateral support member 18 is preferably located further forward for greater stability. A second cable 86 passes around pulley 80 and is attached to footbeams 42 along with cable 64 by bolts 68. Alternatively, a single cable may be employed with two end fittings coupled to one of the footbeams in a manner similar to that described for cables 64 and 86, the other footbeam having a clamping arrangement to secure the cable thereto.

Figure 5:
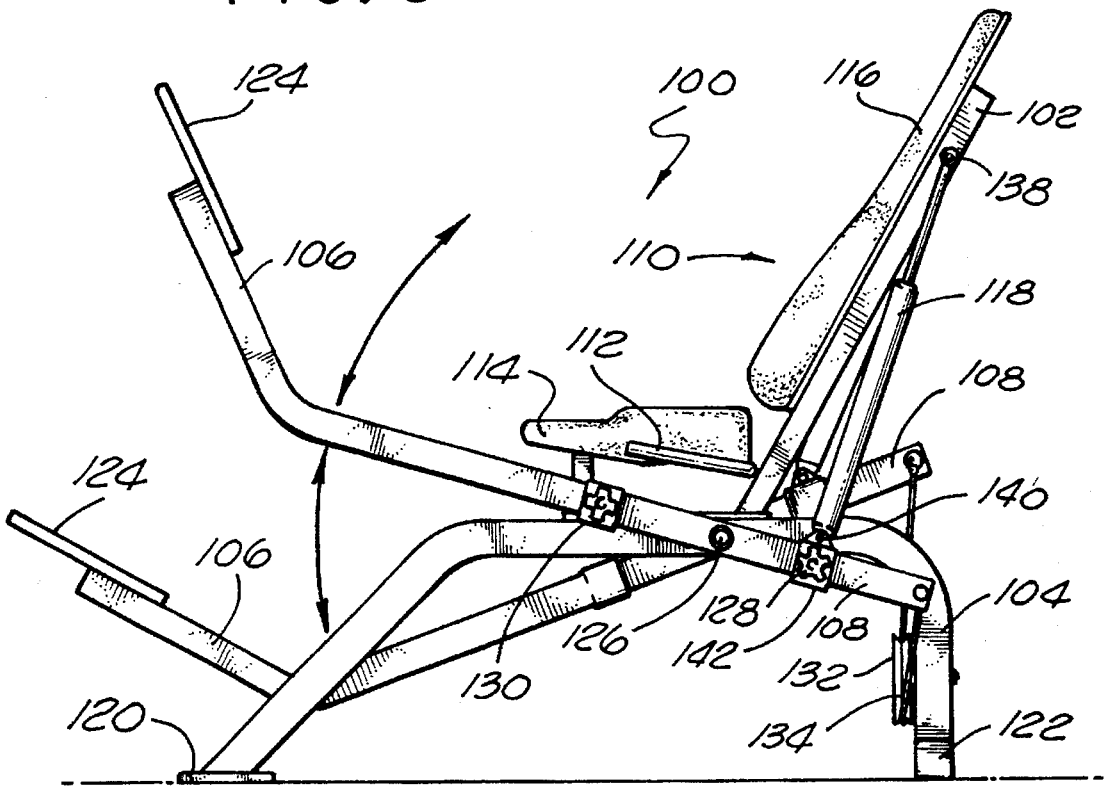
FIG. 5 is a side elevation view of an alternative embodiment.

In another alternative embodiment, apparatus 100 shown in FIG. 5, the pivot point at which the footbeams are coupled to the frame 104 of the apparatus has been moved to a location generally under the seat 110. Each footbeam comprises a forward portion 106 and a rearward portion 108. A footpad 124 is mounted at the end of forward portion 106. Although footpad 124 could be pivotally coupled to the footbeam, a fixed attachment as shown is more effective in exercising the user's calf muscles. As shown in the drawing, the footbeams 106, 108 are pivoted at an intermediate position of each footbeam about pivot pin 126 attached to frame 104. Locating the pivot point below seat cushion 114 in this manner offers certain unique exercising advantages over the configuration of the previously described embodiment. The embodiment illustrated in FIGS. 5 and 6, which provides a recumbent lunge exercise, primarily emphasizes development of the gluteus muscle group as does a conventional lunge exercise performed with free weights, and secondarily develops the upper leg/thigh muscles as does a conventional leg press machine.

As in previous embodiments, the frame 104 rests on front lateral support member 120 and rear lateral support member 122. To provide the necessary resistance to achieve its exercise function, the apparatus 100 employs a resistance means 118 attached to the support member 102 and the footbeam rearward portion 108, just behind the footbeam pivot pin 126. The resistance means 118, shown here as a damper mechanism comprising a piston and cylinder, is coupled to apparatus 100 at pivot pin 138 and at pivot pin 140. As in the previously described embodiment, alternative resistance means, such as a weight and pulley arrangement, may be employed. Hand grips 112 are provided alongside the seat cushion 114 to provide leverage for the user during his or her exercise routine.

With ergonomics in mind, the present invention also provides longitudinal adjustment of the footbeams 106, 108. Specifically, each footbeam 108, 108 is comprised of a forward portion 106 and a rearward portion 108 such that beth portions are arranged coaxially and concentrically to enable a telescoping action. Accordingly, a user sitting in the seat 110 can comfortably adjust the distance the footpad 124 is away from his or her body by extending or contracting the footbeams. After this adjustment is made, a locking knob 130 frictionally holds the footbeam portions 106, 108 in their relative positions.

Adjustment of the length of the footbeams not only accommodates the physiology of the user, it also directs the benefits of the exercise to different muscle groups. Shortening the length of the footbeams will emphasize the gluteus muscles, whereas lengthening the footbeams will emphasize the quadriceps.

To adjust the resistance encountered by the user, the pivot point of the resistance means 118 on the footbeam can be adjusted by loosening locking knob 128 and sliding channel 142 longitudinally along the exterior of the footbeam rearward portion 108. When the exact amount of desired resistance is found, the user can twist the locking knob 128 to frictionally hold the channel 142 in place. The amount of resistance is simply a matter of adjusting the lever arm, which in this instance is the distance between the the footbeam pivot pin 126 (the fulcrum) and the pivot pin 140 (load point).

Figure 6:
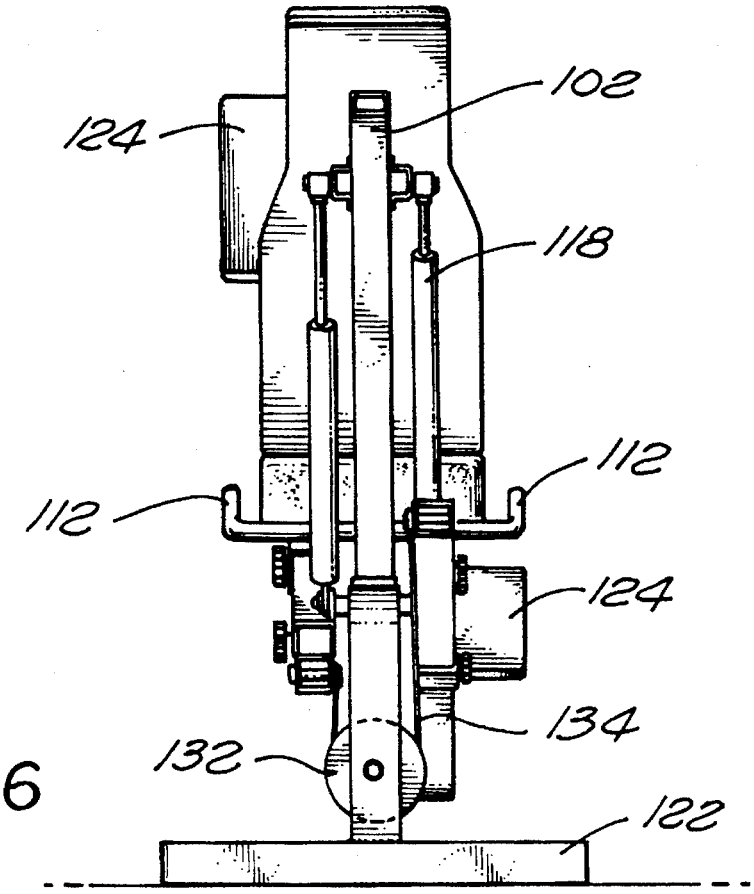
FIG. 6 is an end view of the alternative embodiment of FIG. 5.

As in the previously described embodiment, to generate an alternating pedaling action between the two footbeams, a pulley 132 is mounted to the footbeam rearward portion 108 of each footbeam. The pulley 132 is best seen in FIG. 6. Optionally, the pulley 132 can be directly attached to the frame 104, or a bracket can be used to hold the pulley 132 in place while a cable 134 interconnects the two footbeams. Therefore, as one footbeam swings downward in front, its rear end swings up, pulling on the cable 134 and simultaneously pulling down the rear end of the other footbeam.

In yet another alternative embodiment, the present invention provides an adjustable reclining seat. FIG. 7 provides a partial detailed view of the preferred embodiment for this reclining seat feature and FIG. 8 is a sectional view taken along line 8—8 of FIG. 7. As best seen in FIG. 8, support member 202 pivots with respect to frame 204 about pivot pin 241 by means of bushing 243. Preferably, there is a significant amount of friction in this pivot joint so as to minimize the slack in the seat adjustment. FIG. 7 shows a sector-shaped plate 242 connected to support member 202, which supports back cushion 216. The sector-shaped plate 242 has along its arcuate edge a series of holes 248. To the frame 204 is affixed a mounting plate 244. On the mounting plate 244 is a locking pin 246 which is mounted perpendicular to the plate 244 and extends therethrough. When the seat 210 is installed on the frame 204, the sector-shaped plate 242 engages the mounting plate 244. Tilting the support member 202 helps align a specific hole 248 with the locking pin 246, which is biased by spring 250 to slide into the aligned hole 248. Once the two plates 242, 244 are locked together by pin 246, the angle of recline of the back cushion 216 is set.

Adjustment of the angle of back cushion 216 is useful not only for the comfort of the user, but also for physiological reasons. A greater angle of recline will lower the elevation of the heart and thereby reduce cardiac stress while exercising. Furthermore, adjusting the angle of recline will direct the benefits of the exercise to different muscle groups. A more upright position will emphasize the gluteus and hamstring muscles, whereas a more recumbent position will emphasize the quadriceps. It is preferred that the back cushion be inclined at an angle greater than 30° from the vertical.

Because the seatback support member 202 can be reclined to various angles, the resistance means 218 cannot be conveniently attached thereto. Therefore, in this alternative embodiment, the resistance means 218 is pivotally attached to the main structural frame. In other words, instead of interconnecting the footbeam to the seatback support member as shown in the previous embodiment, the resistance means 218 interconnects the frame 204 or optionally the rear lateral support member 222 to the footbeam rearward portion 208.

Naturally, the reclining action of the back cushion 216 can be adapted to operate on the seat cushion 214 as well. The apparatus 200 can thus have a combination of a reclining back cushion 216 and a tilting seat cushion 214.

Figure 9:
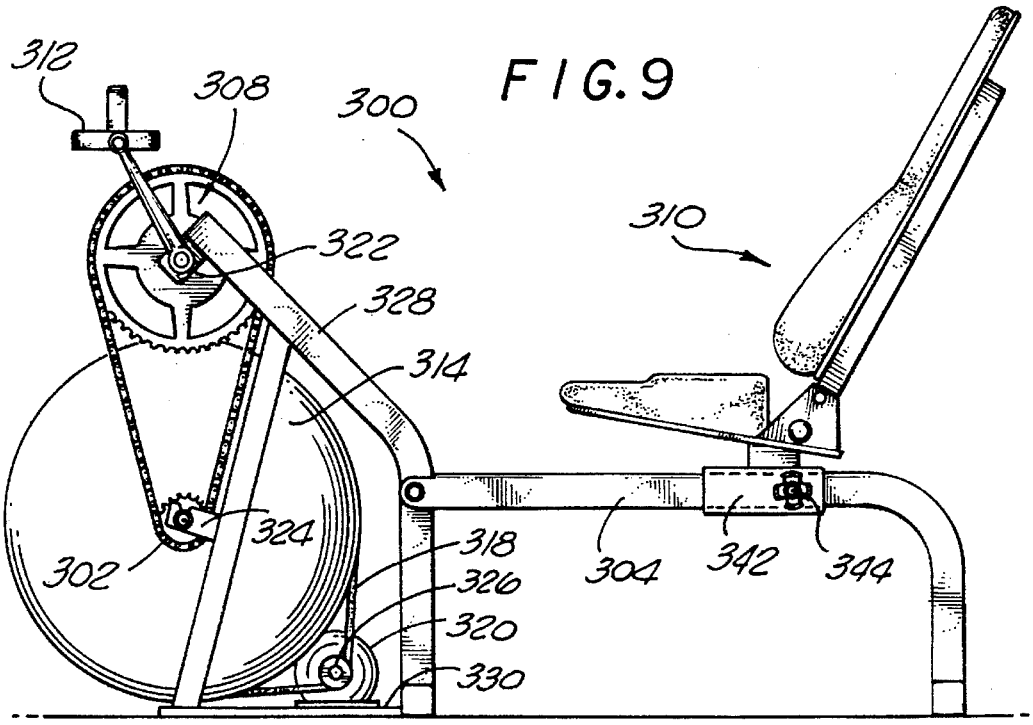
FIG. 9 is a side elevation view of an alternative embodiment using a crank.

In yet another alternative embodiment illustrated in FIG. 9, the present invention provides a recumbent exerciser 300 utilizing a crank and flywheel mechanism shown generally as 308. Specifically, FIG. 9 shows a modified frame comprising a rear member 304 and a forward member 328. Lower bracket 324 is attached to the forward frame member 328 and supports a flywheel 314. Forward frame member 328 also has an upper bracket 322 supporting the crank set 308. The crank set 308 includes foot pedals 312 adapted to receive a user's feet for a pedalling exercise. Motion of crank set 308 is transferred to a sprocket 302 via chain 316. Sprocket 302 is connected to flywheel 314 and both rotate on the same shaft. Rotation of the sprocket 302 thereby rotates flywheel 314. The rotational motion of flywheel 314 is then transferred by belt 318 to the shaft 326 of generator 320. The flywheel 314 serves to dampen or smooth out the exercise so that there is steady resistance perceived by the user. The majority of the resistance, however, is provided by the dynamic braking effect of generator 320. Electrical resistance coupled to the output of generator 320 dissipates the input mechanical energy in the form of heat. Of course, the output of generator 320 may also be used to power various electrical devices.

Mindful of ergonomic concerns, this embodiment preferably incorporates the reclining seat feature of the previous embodiment. Also, the seat 310 can be adjusted longitudinally along the frame 304 to customize the distance the seat 310 is away from the foot pedals 312 based on the user's physical proportions. To do this, the present invention provides a channel 342 which slides along the exterior of frame 304. When the seat 310, which is affixed to the channel 342, is moved into the desired position, the user locks the channel 342 into the frame 304 by twisting the locking knob 344.

It will be recognized that the above described invention may be embodied in other specific forms without departing from the spirit or essential characteristics of the disclosure. Thus it is understood that the invention is not to be limited by the foregoing illustrative examples except as set forth in the appended claims.

What is claimed is:

1. An exercise apparatus comprising:

a frame;

a support coupled to the frame having a user-supporting surface inclined at an angle greater than 30° relative to a vertical direction for supporting a user of said apparatus in an at least partially reclined posture;

a pair of laterally spaced apart beams, each pivotally coupled to the frame at independent pivots on a common pivot axis extending transversely beneath said support, said pivot axis longitudinally located generally within a vertical projection of said support;

a respective footpad coupled to each of the beams and having an operating surface for engagement by a foot of the user while the user is supported by the support, said footpad following an arcuate path of travel as the respective beam pivots on the frame, said path of travel lying substantially forward of the support and also substantially forward of the pivot axis; and resistance means coupled to the beams for resisting pivotal movement thereof in a direction of movement that is downward relative to the support.

2. The apparatus of claim 1 wherein each of the footpads is in approximate horizontal alignment with the support in at least a portion of the respective path of travel.

3. The apparatus of claim 1 wherein each of the beams comprises a rearward portion pivotally coupled to the frame and a forward portion, said forward portion disposed at an angle to the rearward portion.

4. The apparatus of claim 3 wherein the respective footpad of each beam is coupled to a forward end of the forward portion of the beam.

5. The apparatus of claim 1 further comprising a pair of handgrips disposed on opposite sides of the support.

6. The apparatus of claim 1 wherein each of the footpads follows an arcuate path of travel in a respective vertical plane, each such path of travel lying entirely forward of the support.

7. The apparatus of claim 1 further comprising means for interconnecting the beams such that the footpads move reciprocally within their respective paths of travel.

8. The apparatus of claim 1 wherein the footpads are independently movable within their respective paths of travel.

9. An exercise apparatus comprising:

a frame;

a support coupled to the frame having a user-supporting surface for supporting a user of said apparatus in an at least partially reclined posture, at least a back portion of said user-supporting surface being angularly adjustable from substantially upright to an angle greater than 30°;

a pair of laterally spaced apart beams, each pivotally coupled to the frame at independent pivots on a common pivot axis extending transversely beneath said support, said pivot axis longitudinally located generally within a vertical projection of said support;

a respective footpad coupled to each of the beams and having an operating surface for engagement by a foot of the user while the user is supported by the support, said footpad following an arcuate path of travel as the respective beam pivots on the frame, said path of travel lying substantially forward of the support and also substantially forward of the pivot axis; and resistance means coupled to the beams for resisting pivotal movement thereof in a direction of movement that is downward relative to the support.

10. The apparatus of claim 9 further comprising means for interconnecting the beams such that the footpads move reciprocally within their respective paths of travel.

11. The apparatus of claim 9 wherein the footpads are independently movable within their respective paths of travel.

* * * * *

UNITED STATES PATENT AND TRADEMARK OFFICE

CERTIFICATE OF CORRECTION

PATENT NO. : 5,658,223

DATED : August 19, 1997

INVENTOR(S) : Habing et al.

It is certified that error appears in the above-identified patent and that said Letters Patent is hereby corrected as shown below:

On the title page,
item [57] Abstract, line 10, please delete " am " and insert -- are --.

In column 2 at lines 26 and 32, please delete " beck " and insert -- back --.

In column 4 at lines 30 and 44, please delete " 46 " and insert -- 48 --.

In column 5 at line 17, please delete " 64 " and insert -- 84 --.

In column 5 at line 62, please delete " 108 " and insert -- 106 --.

Signed and Sealed this

Twenty-fourth Day of November, 1998

*Attest:*

Bruce Lehman

BRUCE LEHMAN

*Attesting Officer*

*Commissioner of Patents and Trademarks*